US005565422A

United States Patent [19]

Del Greco et al.

[11] Patent Number: 5,565,422

[45] Date of Patent: Oct. 15, 1996

[54] PROCESS FOR PREPARING A FREE-FLOWING PARTICULATE DETERGENT COMPOSITION HAVING IMPROVED SOLUBILITY

[75] Inventors: Angela G. Del Greco; Anne M. Ruh, both of Cincinnati, Ohio

[73] Assignee: The Procter & Gamble Company, Cincinnati, Ohio

[21] Appl. No.: 494,274

[22] Filed: Jun. 23, 1995

[51] Int. Cl.[6] ..... C11D 11/02

[52] U.S. Cl. ..... 510/443; 510/446; 510/452; 159/48.1; 264/128

[58] Field of Search ..... 252/89.1, 174, 252/174.14, 135; 159/3, 4.3, 47.1, 48.1; 264/128

[56] References Cited

U.S. PATENT DOCUMENTS

| | | | |
|---|---|---|---|
| 3,761,549 | 9/1973 | Marshall | 264/15 |
| 3,838,072 | 9/1974 | Smith et al. | 252/540 |
| 3,849,327 | 11/1974 | DiSalvo et al. | 252/109 |
| 3,886,098 | 5/1975 | DiSalvo et al. | 252/540 |
| 4,006,110 | 2/1977 | Kenney et al. | 252/540 |
| 4,083,813 | 4/1978 | Wise et al. | 252/526 |
| 4,166,039 | 8/1979 | Wise | 252/110 |
| 4,637,891 | 1/1987 | Delwel et al. | 252/135 |
| 4,661,281 | 4/1987 | Seiter et al. | 252/140 |
| 4,675,124 | 6/1987 | Seiter et al. | 252/91 |
| 4,715,979 | 12/1987 | Moore et al. | 252/91 |
| 4,818,424 | 4/1989 | Evans et al. | 252/91 |
| 4,820,436 | 4/1989 | Andree et al. | 252/544 |
| 4,849,125 | 7/1989 | Seiter et al. | 252/109 |
| 4,853,143 | 8/1989 | Hardy et al. | 252/102 |
| 4,876,023 | 10/1989 | Dickenson et al. | 252/90 |
| 5,009,804 | 4/1991 | Clayton et al. | 252/90 |
| 5,133,924 | 7/1992 | Appel et al. | 264/342 R |
| 5,149,455 | 9/1992 | Jacobs et al. | 252/174.13 |
| 5,366,652 | 11/1994 | Capeci et al. | 252/89.1 |

FOREIGN PATENT DOCUMENTS

| | | | |
|---|---|---|---|
| 0289312A2 | 11/1988 | European Pat. Off. | C11D 11/02 |
| 0339996A1 | 11/1989 | European Pat. Off. | C11D 11/00 |
| 0351937A1 | 1/1990 | European Pat. Off. | C11D 11/00 |
| 0352135A1 | 1/1990 | European Pat. Off. | C11D 11/00 |
| 0390287A2 | 10/1990 | European Pat. Off. | C11D 17/00 |
| 0451894A1 | 10/1991 | European Pat. Off. | C11D 10/04 |
| 1369269 | 10/1974 | United Kingdom | C11D 11/04 |
| 2166452 | 5/1986 | United Kingdom | C11D 11/00 |
| 2221695 | 2/1990 | United Kingdom | C11D 11/00 |
| 92/06167 | 4/1992 | WIPO | C11D 3/39 |
| 93/14182 | 7/1993 | WIPO | C11D 3/10 |

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process which produces a detergent composition that exhibits improved solubility as well as improved flow properties is provided. The improved solubility can be detected by evidence of increased solubility of the surfactants in the washing solution and/or by the decreased amount of detergent residue left on laundered clothes. It has now been discovered that incorporating nonionic surfactant on and/or in spray-dried detergent granules before cooling the granules and while they are relatively hot, and thereafter cooling and mixing the granules improves the solubility and flow properties of the granules.

9 Claims, No Drawings

PROCESS FOR PREPARING A FREE-FLOWING PARTICULATE DETERGENT COMPOSITION HAVING IMPROVED SOLUBILITY

FIELD OF THE INVENTION

The present invention relates to a process for making a particulate detergent composition exhibiting improved solubility. More specifically, the process comprises spraying nonionic surfactant, in liquid form, onto relatively hot spray-dried granules, cooling the granules and mixing the granules.

BACKGROUND OF THE INVENTION

A main concern over the years for detergent manufacturers has been providing detergent compositions which exhibit good solubility in various wash water conditions. This concern has particularly become important in the field recently with the proliferation of higher density "compact" detergents, i.e., detergent compositions having bulk densities of 600 g/l or higher. Poor solubility of a detergent composition may result in, e.g., clumps of detergent which appear as solid white masses remaining in the washing machine and/or on washed clothes. In particular, such clumps can occur in cold wash water conditions and/or when the order of addition to the washing machine is laundry detergent first, clothes second, and water last.

The various approaches detergent manufacturers have taken to improve the solubility of detergent compositions include: (a) compacting spray-dried granules at low pressures (20 to 200 psi) and granulating the resulting compacted material; (b) combining at least two multi-ingredient components, one being spray-dried and containing slower-dissolving detergent surfactant, the other being agglomerated and containing a faster-solubilizing detergent surfactant; and (c) incorporating admixed hydrophobic amorphous silicate material into a sodium carbonate-containing detergent, bleach, or additive composition.

The prior art discloses spraying nonionic surfactant over the surfaces of spray-dried base detergent beads, but fails to disclose the desirability and/or the practicality of combining the incorporation of nonionic into a spray-dried granule while the granule is relatively hot in combination with cooling and mixing steps. It would be desirable to have detergent granules that exhibit improved solubility and are more crisp and free-flowing than the aforementioned prior art granules.

Therefore, despite the aforementioned disclosures in the art, there remains a need for a process which provides a detergent composition having improved solubility. There is also a need for such a process which provides a detergent composition which has improved flow properties in that it is more crisp and free-flowing.

BACKGROUND ART

The following references relate to detergent granules, the solubility thereof and/or the flow properties of such granules: U.S. Pat. No. 4,715,979 (Moore et al); U.S. Pat. No. 5,009,804 (Clayton et al); WO 93 14182 (Morgan et al); U.S. Pat. No. 3,838,072 (Smith et al); U.S. Pat. No. 3,849,327 (DiSalvo et al); U.S. Pat. No. 4,006,110 (Kenny et al); U.S. Pat. No. 5,149,455 (Jacobs et al); and U.S. Pat. No. 4,637,891 (Delwel et al). U.S. Pat. No. 5,366,652 (Capeci et al) relates to making detergent agglomerates.

SUMMARY OF THE INVENTION

The instant invention meets the needs identified above by providing a process which produces a detergent composition that exhibits improved solubility as well as improved flow properties. The improved solubility can be detected by evidence of increased solubility of the surfactants in the washing solution and/or by the decreased amount of detergent residue left on laundered clothes. It has now been discovered that incorporating nonionic surfactant on and/or in spray-dried detergent granules before cooling the granules and while they are relatively hot, and thereafter cooling and mixing the granules improves the solubility and flow properties of the granules. All percentages, ratios and proportions used herein are by weight, unless otherwise specified. All documents including patents and publications cited herein are incorporated herein by reference.

In accordance with one aspect of the invention, a process for producing a free-flowing, particulate detergent composition having improved solubility is provided. The process comprises the steps of: A) spray drying an aqueous slurry containing an anionic surfactant and a detersive builder so as to form spray dried granules having a temperature in a range of from about 80° C. to about 120° C.; B) spraying a nonionic surfactant in substantially liquid form on said spray dried granules while said spray dried granules have a temperature within said range; C) cooling spray dried granules to a temperature between about 40° C. and about 70° C.; and D) mixing said spray dried granules to improve the flow properties thereof, thereby resulting in the formation of said detergent composition.

In accordance with another aspect of the invention, another process for preparing a free-flowing, particulate detergent composition having improved solubility is provided. The process comprises the steps of: A) spray drying an aqueous slurry containing an anionic surfactant and a detersive builder so as to form spray dried granules having a temperature in a range of from about 80° C. to about 120° C.; B) spraying a nonionic surfactant in substantially liquid form on said spray dried granules while said spray dried granules have a temperature within said range; C) cooling spray dried granules to a temperature between about 40° C. and about 70° C.; and D) grinding said spray dried granules such that said spray dried granules have a mean particle size of from about 300 microns to about 600 microns, thereby resulting in the formation of said detergent composition.

Also provided is the free-flowing, particulate detergent compositions produced according to the process inventions described herein.

Accordingly, it is an object of the invention to a process which provides a detergent composition having improved solubility. It is an object of the invention to provide a process which provides a detergent composition which has improved flow properties in that it is more crisp and free-flowing. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENTS

The process for making the detergent composition herein generally comprises spray drying an aqueous slurry containing an anionic surfactant and a builder into spray dried granules, spraying a nonionic surfactant on the spray-dried granules followed by cooling and mixing the granules. The various essential and adjunct detergent ingredients and equipment used in the process are described in detail below.

The Process

The spray dried granules which are formed in step A of the process herein are prepared according to known processes for spray-drying aqueous mixtures. Such processes include spray drying conventional detergent ingredients, e.g., detergent surfactants and detergency builders, to form spray dried granules, typically in relatively tall spray drying towers. The spray drying step of the process preferably includes dispersing an aqueous slurry or mixture under high pressure through nozzles down a spray drying tower through which hot gases are counter-currently flowing up the tower. This process step can be carried out in conventional spray drying equipment such as the aforementioned towers as well as other spray drying apparatus.

Preferably, the resulting spray dried granules formed in the spray drying apparatus have a temperature from about 80° C. to about 120° C., and more preferably from about 80° C. to about 105° C. While not intending to be bound by theory, it is believed that the anionic surfactant in the spray dried granules is in a more "liquid" crystalline state when compared to the anionic surfactant in the granules after cooling which is in a more "structured" crystalline state. The "liquid" crystalline anionic surfactant state allows the nonionic surfactant to penetrate into the spray dried granule better than the "structured" crystalline anionic surfactant found in spray dried granules after cooling. The higher temperature itself of the spray dried granule also promotes greater penetration of nonionic surfactant. As a consequence of the penetration and complete nonionic coating of the granules while they are at a relatively hot temperature, the solubility of the composition is improved in the washing solution.

Preferably, the aqueous slurry used to produce the spray dried granules formed in step A of the process comprise the anionic surfactant, the builder and no more than about 1.0%, preferably 0%, by weight of nonionic surfactant. The amount of nonionic in the aqueous slurry is based on limitations concerning environmental and safety concerns (plume opacity, auto-oxidation) and limitations concerning the physical properties of the slurry used during the spray drying process step, i.e., step A.

In the second step of the process herein, step B, nonionic surfactant is incorporated into spray-dried detergent granules by spraying the nonionic while it is substantially in the liquid state. To facilitate that end, the nonionic surfactant preferably has a melting point between about 25° C. and about 60° C., and is preferably heated to between about 25° C. and about 105° C., more preferably between 60° C. and 95° C. As the spray dried granules exit a spray drying tower, the anionic surfactant in the granules is in a predominantly liquid crystalline state which allows for better penetration of the nonionic surfactant into the granules. After cooling of the spray dried granules, the anionic surfactant is in a more structured crystalline state which does not lend itself as well to penetration of the nonionic as does the liquid crystal state. The physical properties of the detergent granules after cooling also limits the amount of nonionic that can be incorporated after cooling of the granules, e.g., there is a significant decrease in the flowability of the granules after cooling. At or near the exit of the spry drying tower, the nonionic surfactant is sprayed onto the granules. The amount of nonionic surfactant is from about 5% to about 20%, preferably from about 1% to about 5%, and most preferably from about 1% to about 2%, by weight of the overall detergent composition.

Conventional methods and equipment can be used in step B to spray the nonionic surfactant on the granules so long as they provide sufficient liquid-to-solid particle contact to incorporate the nonionic surfactant into the spray dried granules sufficiently. Such methods include one- or two-fluid nozzle arm positioned horizontally or vertically into a baffled or un-baffled mix drum, single or two-fluid nozzle system spraying onto a horizontal conveyor belt, into a bucket elevator system, into a gravity-fed product chute, or onto a screw conveyor and any other device which provides suitable means of liquid spray-on and preferably agitation. The apparatus may be designed or adapted for either continuous or batch operation as long as the essential process steps can be achieved. Examples of agitation equipment that is preferably used in this step include Lödige KM mixer, a V-blender, an inclined tumbling drum, or a bel; or screw conveyor.

Once the spray dried granules have been sprayed with nonionic surfactant, the granules are cooled in step C to a temperature from about 15° C. to about 40° C., preferably from about 20° C. to about 35° C., more preferably from about 25° C. to about 30° C. Preferably, this cooling step is conducted in an airlift apparatus which provides from about 0.1 to 1 minutes residence time, more preferably from about 0.8 to about 0.9 minutes residence time. While not intending to bound by theory, it is believed that the residence time is required to allow for the penetration of the nonionic surfactant applied earlier into the detergent granule and for the granule to cool and form a more structured crystalline particle. Other conventional apparatus and methods which provide cooling capacity sufficient to cool the detergent granules can be used. Such apparatus include fluid bed coolers, vented tumbling drum, vented belt conveyor, or vented chute work. The residence time in such apparatus will vary, for example, use of a fluid bed cooler to cool the granules involve residence times on the order of from about 5 minutes to about 20 minutes.

The next step in the instant process comprises mixing the cooled granules to enhance the flow properties of the composition in which the granules are contained. Preferably, the mixing step will include the step of grinding the granules, wherein the mean particle size of the granules is reduced to from about 300 microns to about 600 microns, more preferably from about 400 microns to about 500 microns. As used herein "grinding" comprises any method which results in decreasing the mean particle size of the cooled granules such that substantially spherical, uniform granules are formed. Methods of grinding particulate components are well-known to those skilled in the art. This process step reduces coarse granules, rounds off irregularly shaped granules and compacts "fines".

The mixing and/or grinding apparatus may be designed or adapted for either continuous or batch operation. Examples of such apparatus are described in, e.g., U.S. Pat. No. 5,149,455 (Jacobs et al); U.S. Pat. No. 5,133,924 (Appel et al); and EP Patent 351,937 (Hollingsworth et al), all incorporated herein by reference and include the Lödige CB mixer/densifiers, vertical agglomerators/mixers (preferably a continuous Schugi Flexomix or Bepex Turboflex), other agglomerators (e.g. Zig-Zag agglomerator, pan agglomerators, twin cone agglomerators, etc.) rotating drams, and any commercially available grinders or particle size reducers.

In a preferred embodiment of the process herein, from about 75% to about 90%, by weight of the overall detergent composition, of the nonionic surfactant is incorporated into the spray dried granules prepared in accordance with process steps described above. Optionally, a portion of this nonionic surfactant can be incorporated in the mixing step of the process herein.

Once the spray dried granules have been made in accordance with the process herein, the granules can be used as the detergent composition itself or optionally, other detergent components can be admixed to form the composition. Additionally, optional process steps include may be employed such as adding a coating agent to the spray dried granules for purposes of further enhancing the flow properties of the composition. Preferably, this is completed at any stage of the process after the cooling step. The coating agent is preferably selected from the group consisting of aluminosilicates, carbonates and mixtures thereof. Other optional process steps include particle size classification by screening, spray addition of liquid perfumes, liquid dyes, or other detergent components, including addition of more nonionic surfactant. mixing of the base granules with other dry detergent components and subsequent.

Detergent Surfactant

The detergent compositions produced by the process invention herein preferably comprise from about 5% to about 40%, more preferably from about 10% to about 35%, most preferably from about 15% to about 30%, by weight of the composition, of detergent surfactant. The detergent surfactant can be selected from the group consisting of anionics, nonionics, zwitterionics, ampholytics, cationics, and mixtures thereof. Preferred compositions comprise a detergent surfactant selected from the group consisting of anionics, nonionics and mixtures thereof. More specifically, the detergent compositions of the invention herein comprises from about 5% to about 35%, preferably from about 10% to about 30%, most preferably 15% to about 30%, by weight of anionic surfactant.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS.

Especially preferred are mixtures of $C_{11-16}$ (preferably $C_{11-13}$) linear alkylbenzene sulfonates and $C_{12-18}$ (preferably $C_{14-16}$) alkyl sulfates. These are preferably present in a weight ratio of between 4:1 and 1:4, preferably about 3:1 to 1:3, alkylbenzene sulfonate:alkyl sulfate. Sodium salts of the above are preferred.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

The detergent compositions of the invention herein also comprise nonionic surfactant as described previously. Depending on the nonionic surfactant, the nonionic surfactant can be incorporated into the detergent composition as an integral part of the spray dried granule and/or via the spraying step of the process herein. A portion of the nonionic surfactant can also be incorporated after mixing and/or grinding the granules. Preferably, a portion of the nonionic surfactant is incorporated in at least each of these steps.

Generally, water-soluble nonionic surfactants are useful in the instant detergent compositions. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Semi-polar nonionic surfactants include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)OH$, wherein $R^1$ is a $C_{10}$–$C_{16}$ alkyl group or a $C_8$–$C_{12}$ alkyl phenyl group, and n is from 3 to about 80.

Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

In a preferred embodiment, the nonionic surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred ethoxylated nonionic surfactant is derived from a straight chain fatty alcohol containing from about 16 to about 20 carbon atoms ($C_{16-20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide in an amount up to about 15% by weight of the surfactant and retain the advantages hereinafter described. Preferred surfactants of the invention can be prepared by the processes described in U.S. Pat. No. 4,223,163, issued Sep. 16, 1980, Builloty, incorporated herein by reference.

The most preferred composition contains the ethoxylated monohydroxyalcohol or alkyl phenol and additionally comprises a polyoxyethylene, polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds that meet the requirements described hereinbefore include those based on ethylene glycol, propylene glycol, glycerol, trimethylolpropane and ethylenediamine as the initiator reactive hydrogen compound. Polymeric compounds made from a sequential ethoxylation and propoxylation of initiator compounds with a single reactive hydrogen atom, such as $C_{12-18}$ aliphatic alcohols, do not provide satisfactory suds control in the detergent compositions of the invention. Certain of the block polymer surfactant compounds designated PLURONIC and TETRONIC by the BASF-Wyandotte Corp., Wyandotte, Mich., are suitable in the surfactant compositions of the invention.

A particularly preferred embodiment contains from about 40% to about 70% of a polyoxypropylene, polyoxyethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Because of the relatively high polyoxypropylene content, e.g., up to about 90% of the block polyoxyethylene-polyoxypropylene polymeric compounds of the invention and particularly when the polyoxypropylene chains are in the terminal position, the compounds are suitable for use in the surfactant compositions of the invention and have relatively low cloud points. Cloud points of 1% solutions in water are typically below about 32° C. and preferably from about 15° C. to about 30° C. for optimum control of sudsing throughout a full range of water temperatures and water hardnesses.

In addition to the anionic and nonionic surfactants required in the detergent compositions of the invention herein, the detergent compositions may also contain surfactants selected from the group of ampholytic, zwitterinoic, cationic surfactants and mixtures thereof.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Detergency Builders

Builders are typically employed to sequester hardness ions and to help adjust the pH of the laundering liquor. Such builders can be employed in concentrations up to about 85%, preferably from about 5% to about 50%, most preferably from about 10% to about 30%, by weight of the resultant compositions of the invention herein to provide their builder and pH-controlling functions. The builders herein include any of the conventional inorganic and organic water-soluble builder salts.

Such builders can be, for example, water-soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates.

Nonphosphorus-containing materials can also be selected for use herein as builders. Specific examples of nonphosphorus, inorganic detergent builder ingredients include water-soluble bicarbonate, and silicate salts. The alkali metal, e.g., sodium and potassium, bicarbonates, and silicates are particularly useful herein.

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $$Na_{12}[(AlO_2)_{12}.(SiO_2)_{12}].xH_2O$$

wherein x is from about 20 to about 30, especially about 27.

Water-soluble, organic builders are also useful herein. For example, the alkali metal, polycarboxylates are useful in the present compositions. Specific examples of the polycarboxylate builder salts include sodium and potassium, salts of ethylenediaminetetraacetic acid, nitrilotriacetic acid, oxydisuccinic acid, mellitic acid, benzene polycarboxylic acid, polyacrylic acid, and polymaleic acid.

Other desirable polycarboxylate builders are the builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

The compositions herein preferably contain little (e.g., less than 10%, preferably less than 5%, by weight) or no phosphate builder materials. The presence of higher levels of tripolyphosphate improves solubility of the compositions to the point where hydrophobic amorphous silicate provides little or no additional improvements. However, sodium pyrophosphate reduces solubility so that the benefit provided by the hydrophobic amorphous silicate is greater in granular compositions containing pyrophosphate.

Other Ingredients

Bleaching agents and activators useful herein are also described in U.S. Pat. No. 4,412,934, Chung et al., issued Nov. 1, 1983, U.S. Pat. No. 4,483,781, Hartman, issued Nov. 20, 1984, U.S. Pat. No. 4,634,551, Burns et al, issued Jan. 6, 1987, and U.S. Pat. No. 4,909,953, Sadlowski et al, issued Mar. 20, 1990, all of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Other ingredients suitable for inclusion in a granular laundry detergent composition can be added to the present compositions. These include bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in U.S. Pat. No. 3,936,537, issued Feb. 3, 1976 to Baskerville, Jr. et al., incorporated herein by reference.

The following non-limiting Examples illustrate the process of the invention and facilitates its understanding. As used in the following Examples, "LAS" is $C_{14-15}$ alkylbenzene sulfonate surfactant, "AE(0.35)S" is $C_{14-15}$ alkyl ethoxylated sulfate (EO=0.35) surfactant, "PEG" is polyethylene glycol, and "Nonionic" is $C_{12-13}$ alkyl ethoxylate (EO=6.5).

EXAMPLE I

The following example illustrates the process of the invention and the detergent composition produced by it.

| | % Weight |
|---|---|
| Base Granule Composition | |
| 65%/35% LAS/AE(0.35)S | 16.55 |
| Aluminosilicate | 26.30 |
| Sodium Carbonate | 11.27 |
| Sodium Silicate (1.6r) | 0.60 |
| Polyacrylate | 3.24 |
| Brightener | 0.20 |
| PEG (MW = 4000) | 1.74 |
| Sulfate | 8.85 |
| Moisture | 9.26 |
| Misc | 0.33 |
| | 78.34 |
| Nonionic Spray-On after Tower | 2.00 |
| Finished Product | |
| Sodium Carbonate | 16.16 |
| Sodium Perborate | 1.00 |
| Perfume | 0.40 |
| Nonionic Spray-On after mixer | 1.00 |
| Enzymes | 1.10 |
| | 100.00 |

The above base granule is prepared into an aqueous slurry mix in any commercially available heated detergent crutcher and spray dried in a counter-current spray drying tower. The drying air has an inlet temperature of about 310° C., and an outlet temperature of about 90°–105° C. The spray dried granular product exits the spray drying tower at a temperature of about 100° C. and falls via a chute onto a moving cross conveyor belt. The product stream on the belt is about 15–25 cm wide and 3–6 cm deep. As the base spray dried granules pass on the belt, 2.00% by weight of $C_{12-13}$alkyl ethoxylate (EO=6.5) nonionic surfactant in a liquid state at a temperature of about 140° C. is sprayed on the granules using four nozzles spread along the distance of the belt, and spaced at even intervals in the first 50% of the belts distance from the tower end. This positioning takes advantage of the higher temperature of the product at the tower end of the belt. The nozzles are two-fluid, that is using a parallel air stream to assist in evenly dispersing the liquid nonionic onto the product on the belt. Nozzles are positioned 20–30 cm above the product, and the nozzle delivers a square footprint which minimizes spray onto the edge of the belt or into the belt housing, thereby minimizing maintenance, maximizing reliability of the process, and maximizing metering accuracy of the liquid nonionic to the base granule.

To enhance the mixing of the liquid into the product stream, two chains are positioned in the last 50% of the belt length. These link chains lay directly on the belt and serve to roll-over and tumble the product, thereby mixing the top liquid-loaded layer into the un-coated lower layer. The nonionic at this time permeates the base granule, allowing the nonionic surfactant to mix with the anionic surfactant of the base granule. Because the anionic surfactant is still in a liquid phase at this time, and has yet to cool and crystallize, the nonionic is able to actually intersperse with the anionic. This mixing of surfactants is a factor in the improved solubility of the product.

From the exit end of the belt, the product is exposed to an airlift, where-by the total mass of the product stream is picked-up by a stream of air and conveyed vertically to the top of the airlift. The base granule stream exits the particle size classifier at the top of the airlift at a temperature of about 50° C. The total residence time from the point of nonionic application at the base of the spray tower to the exit chute at the top of the airlift is between 20 and 60 seconds.

Thereafter, the base granules are fed directly into a L ödige CB-100 mixer which is operated at a speed of about 300 rpms. The flowrate is dependent on the rate of the spray-tower. The CB-100 breaks apart large base granules, thereby exposing the inside surface area and increasing the overall surface area of the product, while also allowing any liquid nonionic which did not permeate the base granules to be mixed from the surface of one base granule into the newly exposed inside surface of another base granule. This mixing step increases the permeation of the liquid nonionic surfactant into the anionic surfactant, improving even further the solubility of the product as well as the flow properties of the detergent composition. The CB-100 mixer also decreases the average particle size of the product by about 100 microns and therefore also serves as a grinder. The decreased particle size, or increased surface area, also improves the solubility and flow properties of the detergent composition. After exiting the Lödige CB-100, the base granules are mixed with other detergent ingredients per the above formulation.

When tested for solubility, the product is found to be unexpectedly substantially better than the same product that did not undergo the described process. When tested for physical flow properties, the detergent composition has unexpectedly substantially improved cake grade and stability. The detergent composition produced by the process described herein has significantly less sticky, mealy, or cakey properties. Similarly, in a standard stability test which exposes the detergent composition to high humidity and temperature for an extended period of time (e.g. 4 weeks), the detergent composition produced according to the instant process unexpectedly demonstrated a substantially improved stability profile, improved resistance to moisture gain, improved cake grades, and improved scoopability. Scoopability is a key consumer attribute as it measures the resistance of the product to scooping using the standard laundry scoop.

EXAMPLE II

This Example illustrates another process and composition produced thereby in accordance with the invention.

| | % Weight |
|---|---|
| Base Granule Composition | |
| 55%/45% LAS/AE(O.35)S | 16.42 |
| Aluminosilicate | 26.50 |
| Sodium Carbonate | 1.43 |
| Sodium Silicate (1.6r) | 0.60 |
| Polyacrylate | 2.57 |
| Brightener | 0.20 |
| PEG (MW = 4000) | 1.76 |
| Sulfate | 37.56 |
| Moisture | 8.10 |
| Misc | 0.48 |
| | 95.42 |
| Nonionic Spray-On after Tower | 1.25 |
| Finished Product | |
| Sodium Perborate | 2.18 |
| Perfume | 0.17 |
| Nonionic Spray-On after mixer | 0.25 |
| Suds Suppresser | 0.10 |
| Enzymes | 0.63 |
| | 100.00 |

The detergent composition presented above was made as described in Example I above. The detergent composition demonstrates the same unexpected substantially improved flow properties and solubility as recited in Example I. In this example >80% by weight of the total nonionic surfactant in the composition is applied prior to the airlift or the L ödige CB-100 mixer. Additionally, this product has significantly fewer admixes and yet, exhibits improved flow properties. Admixes, especially the inorganic salts like sodium carbonate, sodium sulfate, and sodium chloride, are known to improve the physical properties of a detergent product. The process described in this Example allows for a detergent composition that is comprised of greater than 95% by weight of the base granule to have similarly good physical property characteristics. The detergent composition also demonstrates excellent flowability which is a key consumer attribute as it measures how well a detergent pours from a carton or out of a scoop. This attribute is particularly important for those detergent products which are low in admixed ingredients and high in spray-dried base granule composition (e.g. those compositions comprising greater than 90% of the base granule).

Having thus described the invention in detail, it will be obvious to those skilled in the art that various changes may be made without departing from the scope of the invention and the invention is not to be considered limited to what is described in the specification.

What is claimed is:

1. A process for preparing a free-flowing, particulate detergent composition having improved solubility comprising the steps of:

A. spray drying an aqueous slurry containing an anionic surfactant and a detersive builder so as to form spray dried granules having a temperature in a range of from 100° C. to about 120° C.;

B. spraying from about 1% to about 2% by weight a nonionic surfactant in substantially liquid form on said spray dried granules while said spray dried granules have a temperature within said range;

C. cooling spray dried granules to a temperature between about 40° C. and about 70° C.; and D. mixing said spray dried granules to improve the flow properties thereof, thereby resulting in the formation of said detergent composition.

2. The process of claim 1 wherein said mixing step includes grinding said spray dried granules.

3. The process of claim 1 wherein said cooling step is performed in an airlift apparatus.

4. The process of claim 3 wherein the residence time of said spray dried granules in said airlift apparatus is from about 0.1 minute to about 1 minute.

5. A process for preparing a free-flowing, particulate detergent composition having improved solubility comprising the steps of:

A. spray drying an aqueous slurry containing an anionic surfactant and a detersive builder so as to form spray dried granules having a temperature in a range of from 100° C. to about 120° C.;

B. spraying from about 1% to about 2% by weight a nonionic surfactant in substantially liquid form on said spray dried granules while said spray dried granules have a temperature within said range;

C. cooling spray dried granules to a temperature between about 40° C. and about 70° C.; and D. grinding said spray dried granules such that said spray dried granules have a mean particle size of from about 300 microns to about 600 microns, thereby resulting in the formation of said detergent composition.

6. The process of claim 5 wherein said grinding step is performed until said spray dried granules have a mean particle size of from about 400 microns to about 500 microns.

7. The process of claim 5 wherein said cooling step is performed in an airlift apparatus.

8. The process of claim 5 further comprising the step of adding a coating agent to said spray dried granules after said cooling step to enhance the flowability of said detergent composition.

9. The process of claim 8 wherein said coating agent is selected from the group consisting of aluminosilicates, carbonates, and mixtures thereof.

* * * * *